US005713747A

United States Patent [19]

Hsia et al.

[11] Patent Number: 5,713,747

[45] Date of Patent: Feb. 3, 1998

[54] MEMORY CARD CONNECTOR

[75] Inventors: Chih-Hui Hsia, Taipei; L. W. Lu, Tao-Yuan Hsien, both of Taiwan

[73] Assignee: Berg Technology, Inc., Reno, Nev.

[21] Appl. No.: 775,532

[22] Filed: Jan. 2, 1997

Related U.S. Application Data

[63] Continuation of Ser. No. 369,614, Jan. 6, 1995, abandoned.

[51] Int. Cl.[6] ..... H01R 9/09

[52] U.S. Cl. ..... 439/79; 439/541.5

[58] Field of Search ..... 439/64, 59, 74, 439/79, 80, 541.5

[56] References Cited

U.S. PATENT DOCUMENTS

| | | | |
|---|---|---|---|
| 3,478,251 | 11/1969 | Perotto et al. | 317/101 |
| 3,653,006 | 3/1972 | Kohler et al. | 439/74 |
| 3,676,746 | 7/1972 | Kassabgi et al. | 439/79 |
| 3,736,471 | 5/1973 | Donze et al. | 439/59 |
| 4,600,256 | 7/1986 | Antilla | 339/17 M |
| 4,755,911 | 7/1988 | Suzuki | 361/414 |
| 4,858,070 | 8/1989 | Buron et al. | 361/384 |
| 4,964,806 | 10/1990 | Sakamoto et al. | 439/80 |
| 5,085,590 | 2/1992 | Galloway | 439/95 |
| 5,113,317 | 5/1992 | Howe | 361/413 |
| 5,151,033 | 9/1992 | Kawai et al. | 439/95 |
| 5,161,999 | 11/1992 | Broschard et al. | 439/567 |
| 5,194,010 | 3/1993 | Dambach et al. | 439/79 |
| 5,201,662 | 4/1993 | Roche | 439/79 |
| 5,224,019 | 6/1993 | Wong et al. | 361/393 |
| 5,224,865 | 7/1993 | Woith et al. | 439/67 |
| 5,225,968 | 7/1993 | Ma | 361/413 |
| 5,259,783 | 11/1993 | Hileman et al. | 439/372 |
| 5,260,854 | 11/1993 | Hileman et al. | 361/736 |
| 5,267,876 | 12/1993 | Rupert et al. | 439/540 |
| 5,268,820 | 12/1993 | Tseng et al. | 361/785 |
| 5,277,615 | 1/1994 | Hastings et al. | 439/377 |
| 5,286,207 | 2/1994 | McHugh et al. | 439/64 |
| 5,290,174 | 3/1994 | Woratyla et al. | 439/59 |
| 5,297,966 | 3/1994 | Brennian et al. | 439/64 |
| 5,299,089 | 3/1994 | Lwee | 361/684 |
| 5,305,182 | 4/1994 | Chen | 361/684 |
| 5,308,251 | 5/1994 | Kaufman et al. | 439/64 |
| 5,316,488 | 5/1994 | Gardner et al. | 439/79 |
| 5,318,452 | 6/1994 | Brennian et al. | 439/79 |
| 5,324,204 | 6/1994 | Lwee | 439/64 |
| 5,334,046 | 8/1994 | Brouillette et al. | 439/540 |
| 5,399,105 | 3/1995 | Kaufman et al. | 439/609 |
| 5,401,176 | 3/1995 | Lwee | 439/64 |
| 5,408,386 | 4/1995 | Ringer et al. | 361/785 |
| 5,415,569 | 5/1995 | Colleran | 439/620 |
| 5,490,791 | 2/1996 | Yamada et al. | 439/159 |

FOREIGN PATENT DOCUMENTS 238008 1/1982 Taiwan .

OTHER PUBLICATIONS

IBM Technical Disclosure, Planar I/O Port, vol. 33, No. 8, p. 430, Jan. 1991.

BM Engineering, Inc. PCMCIA, Sep., 1994, pp. 27, 28 and 29.

*Primary Examiner*—Neil Abrams

*Attorney, Agent, or Firm*—Daniel J. Long; M. Richard Page

[57] ABSTRACT

An assembly of stacked memory card connectors comprising a lower memory card connector and an upper memory card connector superimposed over the lower memory card connector. Each memory card connector comprises a header and a carrier connected to the header, wherein the header is provided with a plurality of pins extended in both inward and outward directions. The inward pins are used for inserting a memory card to be received in the carrier. A lower and a higher vertical circuit board is electrically connected to the outward pins of each header. These two vertical circuit boards are positioned in parallel spaced relation. The lower end of each vertical circuit board is detachably inserted into a female connector securely mounted to the surface of a main board for electrical connection.

3 Claims, 3 Drawing Sheets

MEMORY CARD CONNECTOR

This application is a continuation of application Ser. No. 08/369,614, filed Jan. 6, 1995, abandoned.

BACKGROUND OF THE INVENTION

1. Field of the Invention This invention relates to a connector, and more particularly, to a memory card connector for use in notebook computers, PC printers and palmtop computers which can expand the space under the connector for installing electronic components and can be maintained easily.

2. Brief Description of the Prior Developments

Rapid progress in various personal computer technologies and improvements in shrinking-size components may make notebook computers the most popular computers in the computer market in the future. For note book computers (or PC printers, palmtop computers) equipped with PCMCIA (Personal Computer Memory Card International Association) slots, memory card connectors are used for connecting PCMCIA cards loaded in the slots to the mainboard of the notebook. A conventional memory card connector is usually installed on a mainboard by using SMT (Surface Mounting Technology) which solders the pins of the connector directly to the surface of the mainboard. Such rigid connection usually causes serious maintenance problems if the connector is to be replaced later on. Besides, the bottom of the conventional memory card connector is directly placed on the surface of the mainboard. The occupied area under the connector can not be used for other purposes such as installing electronic components. Such waste in mainboard space is usually not tolerable in notebook computers which have very restrictive mainboard space.

SUMMARY OF THE INVENTION

The memory card connector of the present invention may be detachably mounted on a mainboard. The memory card connector comprises a header and a carrier connected to the header, wherein the header is provided with a plurality of pins extended in both inward and outward directions, and a vertical circuit board is electrically and securely connected to the outward pins of the header. The lower end of the circuit board is detachably inserted into a female connector of the mainboard.

In the memory card connector of the present invention the height of the circuit board of the connector can also be set according to the requirement of a specific application of the connector so that the space (stand-off) between the connector and the mainboard can be properly utilized.

Additionally, two memory card connectors which may be stacked together, such that the outward pins of the upper connector are longer than the outward pins of the lower connector and the two vertical circuit boards respectively connected to the upper and lower connectors are detachably and vertically connected to two corresponding female connectors of the mainboard separately.

BRIEF DESCRIPTION OF THE DRAWINGS

The memory card connector of the present invention will be more fully understood and appreciated by reference to the written specification in conjunction with the accompanying drawings in which.

DETAILED DESCRIPTION OF THE PREFERRED EMBODIMENTS

Figure 1:
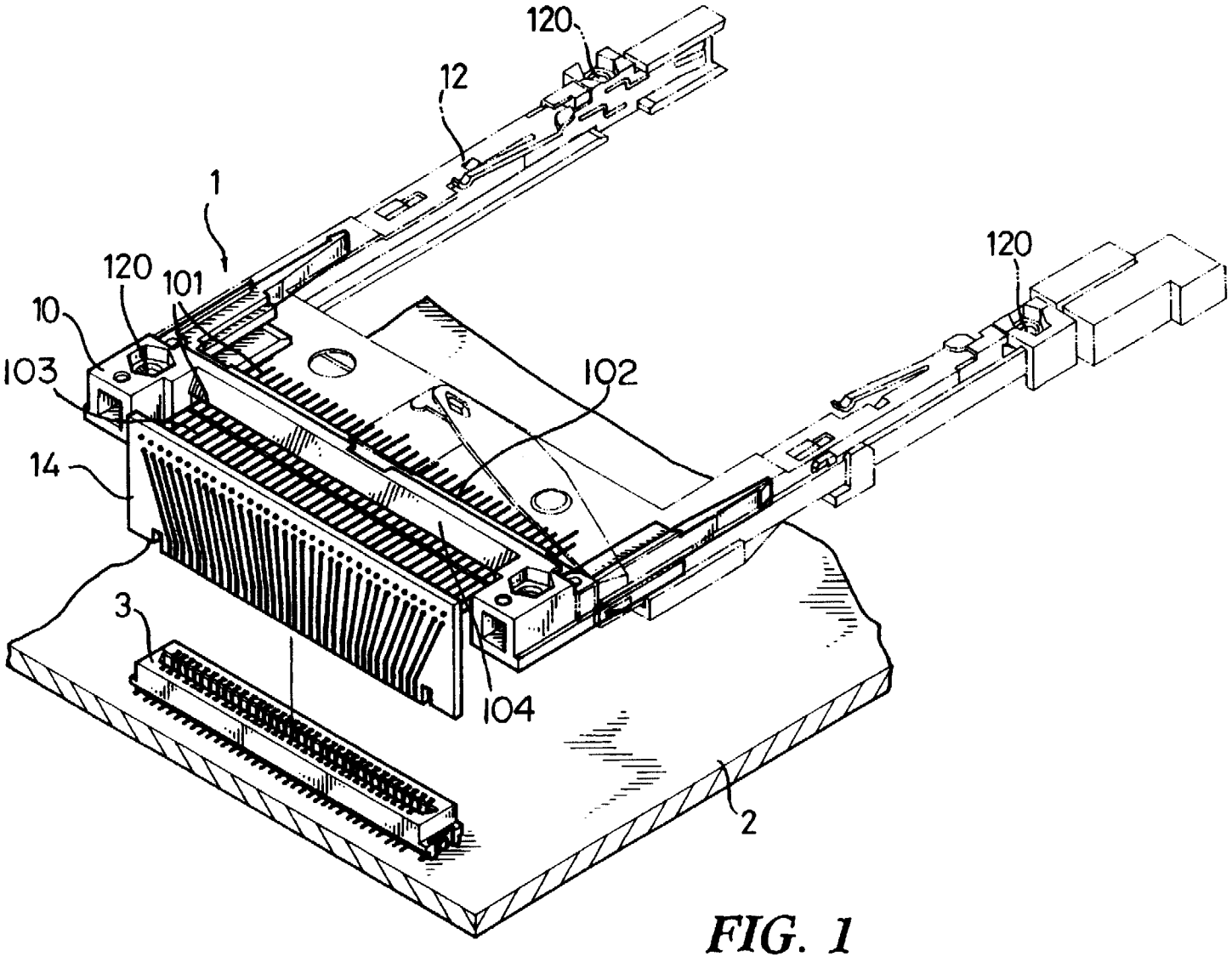
FIG. 1 is an exploded view of a memory card connector and its associated mainboard according to the present invention.

Referring now to FIG. 1, a memory card connector 1 according to the present invention comprises a header 10 and a guide 12 connected to the header 10. The connection between the header 10 and the guide 12 can be fixed or separated in the known manner, which is not the characteristic feature of the invention and is omitted in the description hereinafter. The header 10 is provided with a plurality of pins 101 extended in both inward and outward directions. The inward pins 101 extending from the inward edge 102 of the header are used for inserting a memory card (not shown) to be received in the guide 12. A vertical circuit board 14 is electrically and securely connected to the outward pins 103 extending from the outward edge 104 of the header 10. A female connector 3 is securely mounted to the surface of a mainboard 2 for mounting the memory card connector 1. The lower end of the vertical circuit board 14 is detachably inserted into the female connector 3 to effect electrical connection.

Figure 2:
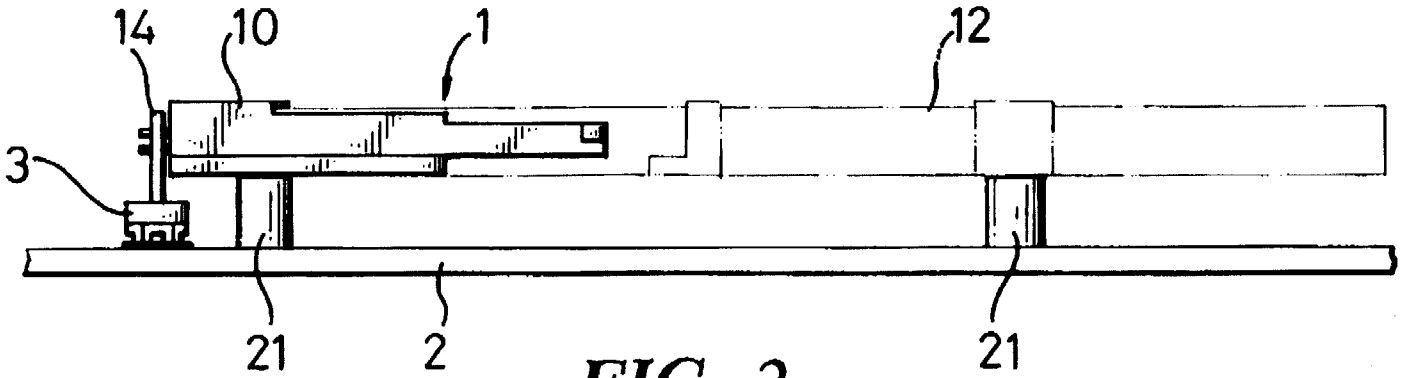
FIG. 2 is a side elevational view illustrating a memory card connector installed on a mainboard according to the present invention.

With reference to FIG. 2, in installing the connector 1 to the mainboard 2, the lower end of the circuit board 14 is directly plugged to the female connector 3 and the bottom of connector 1 is horizontally supported by four studs 21 provided on the mainboard 2. The connector 1 can be fastened to the studs 21 by using screws (not shown) respectively received in the four studs 21 passing through four screw mounting holes 120 of connector 1. The height of the circuit board 14 is set according to the requirement of a specific application of the memory card connector so that the space between the memory card connector 1 and the mainboard 2 can be properly utilized.

Figure 3:
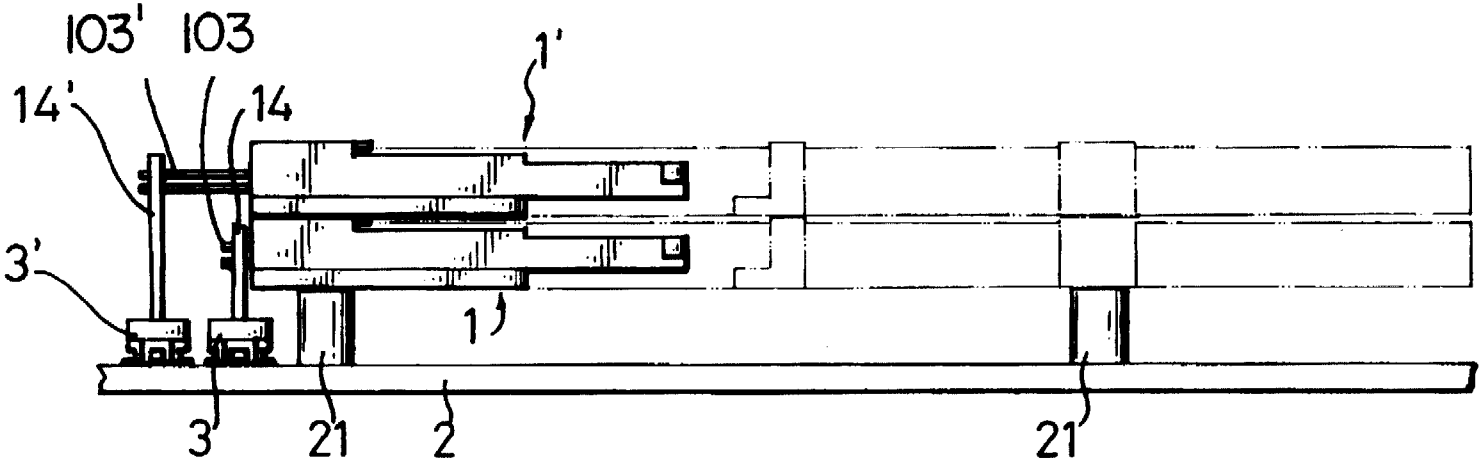
FIG. 3 is a side elevational view illustrating two memory card connectors stacked together and installed on a mainboard according to the present invention.

In FIG. 3, two memory card connectors 1 and 1' are stacked together and installed on the mainboard 2. The outward pins 103' of the upper connector 1' are longer than the outward pins 103 of the lower connector 1. Circuit board 14' in the upper connector 1' is larger to fit the real height as required. Two vertical circuit boards 14' and 14 respectively connected to the upper and lower connectors 1' and 1 are detachably and vertically connected to two corresponding female connectors 3' and 3 of the mainboard 2 separately.

Figure 4:
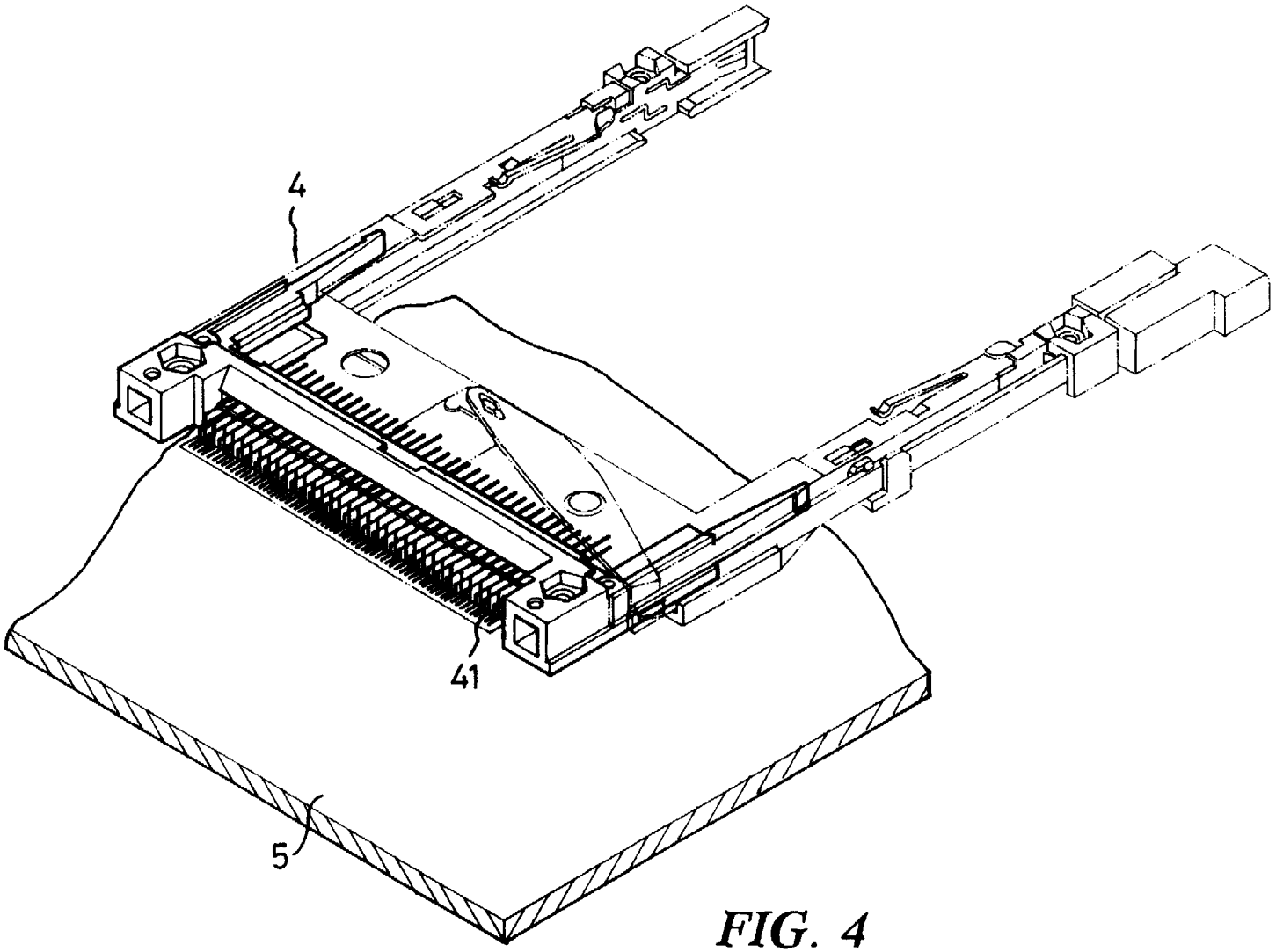
FIG. 4 (PRIOR ART)
FIG. 4 is a perspective view illustrating a conventional memory connector installed on a mainboard.

In FIG. 4, a conventional memory connector 4 installed on a mainboard 5 is illustrated. The connector 4 comprises a plurality of bending pins 41 which are directly soldered to the mainboard 5 by using SMT. As compared with the connector 1 in accordance with the present invention, it is difficult to replace the known installed connector 4 because it is securely fixed on the mainboard 5 which will cause a serious problem in maintenance. Furthermore, there is no space available under connector 4 for use such as installing electronic components.

It will be appreciated that a memory card connector has been described which provides an efficient and economical means for providing space for electronic components.

It will also be appreciated that a method for advantageously connecting a memory card connector to a main circuit board has been provided in which the outwardly extending pins are connected to a vertical circuit board and that vertical circuit board is connected to the main circuit board.

While the structure and features of the present invention have become more apparent from the above detailed description and illustration, it is to be understood that the embodiment has been described only by way of illustrating the preferred operation of the present invention without limiting the scope of the present invention. Therefore, it is intended that any modifications and changes that can be made to the embodiment without departing from the spirit of the present invention are within the scope as set forth in the appended claims.

What is claimed is:

1. An assembly of stacked memory card connectors comprising:

(a) a first memory card connector for connecting a memory card to a main circuit board comprising:

(i) a header having a plurality of inwardly extending pins and a plurality of outwardly extending pins and said outwardly extending pins each having a length;

(ii) electrical conductive means comprising a second circuit board having upper and lower ends and a height and positioned in generally perpendicular relation to the main circuit board and said second circuit board being connected to the outwardly extending pins in said header;

(iii) a first female connector means mounted on the main circuit board wherein the lower end of the second circuit board is detachably engaged with said lower end of said second circuit board;

(iv) support means positioned between the memory card connector and the main circuit board; and (b) a second memory card connector positioned in spaced stacked parallel relation to said first memory card connector and comprising:

(i) a header having a plurality of inwardly extending pins and a plurality of outwardly extending pins and said outwardly extending pins each having a length and said lengths of the outwardly extending pins of the second memory card connector are greater than the lengths of the outwardly extending pins of the first memory card connector;

(ii) electrical conductive means comprising a third circuit board having upper and lower ends and a height and positioned in generally perpendicular relation to the main circuit board in spaced parallel relation to the second printed circuit board and said third circuit board being connected to the outwardly extending pins in said header and said height of said third circuit board being greater than said height of said second circuit board; and (iii) a second female connector means mounted on the main circuit board wherein the lower end of the third circuit board is detachably engaged with said main circuit board.

2. The memory card connector of claim 1 wherein the first memory card connector includes a carrier.

3. The memory card connector of claim 2 wherein the second memory card connector includes a second carrier.

* * * * *